US005261518A

United States Patent [19]

Bryce

[11] Patent Number: 5,261,518

[45] Date of Patent: Nov. 16, 1993

[54] COMBINED CONDUCTIVITY AND MAGNETIC CURRENCY VALIDATOR

[75] Inventor: David R. Bryce, Morrisville, Pa.

[73] Assignee: Brandt, Inc., Bensalem, Pa.

[21] Appl. No.: 29,453

[22] Filed: Mar. 11, 1993

[51] Int. Cl.[5] ..... G07D 7/00

[52] U.S. Cl. ..... 194/206; 209/534

[58] Field of Search ..... 209/534; 194/205, 206, 194/207

[56] References Cited

U.S. PATENT DOCUMENTS

| | | | |
|---|---|---|---|
| 4,114,804 | 9/1978 | Jones et al. | 194/207 X |
| 4,313,087 | 1/1982 | Weitzen et al. | 209/534 X |
| 4,513,439 | 4/1985 | Gurgone et al. | 194/206 X |
| 4,539,702 | 9/1985 | Oka | 209/534 X |
| 4,556,140 | 12/1985 | Okada | 194/206 |
| 4,584,529 | 4/1986 | Aoyama | 209/534 X |
| 4,588,292 | 5/1986 | Collins | 209/534 X |
| 4,749,087 | 6/1988 | Buttifant | 209/534 |

*Primary Examiner*—D. Glenn Dayoan

*Attorney, Agent, or Firm*—Shenier & O'Connor

[57] ABSTRACT

A currency validator for testing both the magnetic and electrically conductive properties of a currency note in which core legs of magnetic and conductive material form spaced first and second gaps. Windings carried by the legs produce signals indicative of the magnetic property of a note moving across the first gap. A detector connected across the second gap indicates the presence of conductive material bridging the first gap.

11 Claims, 2 Drawing Sheets

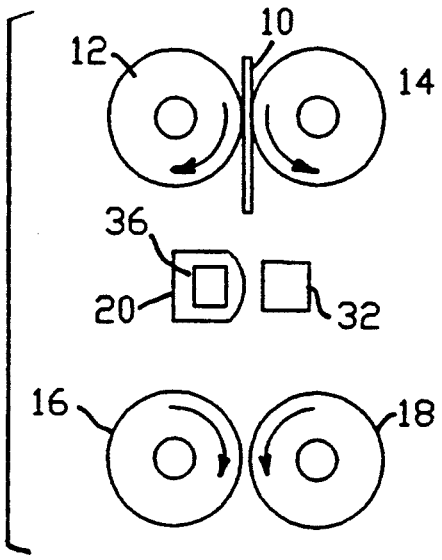
FIG. 1
FIG. 3
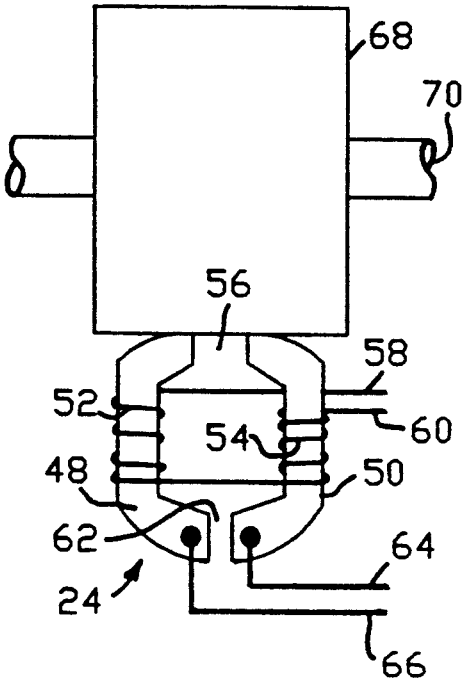
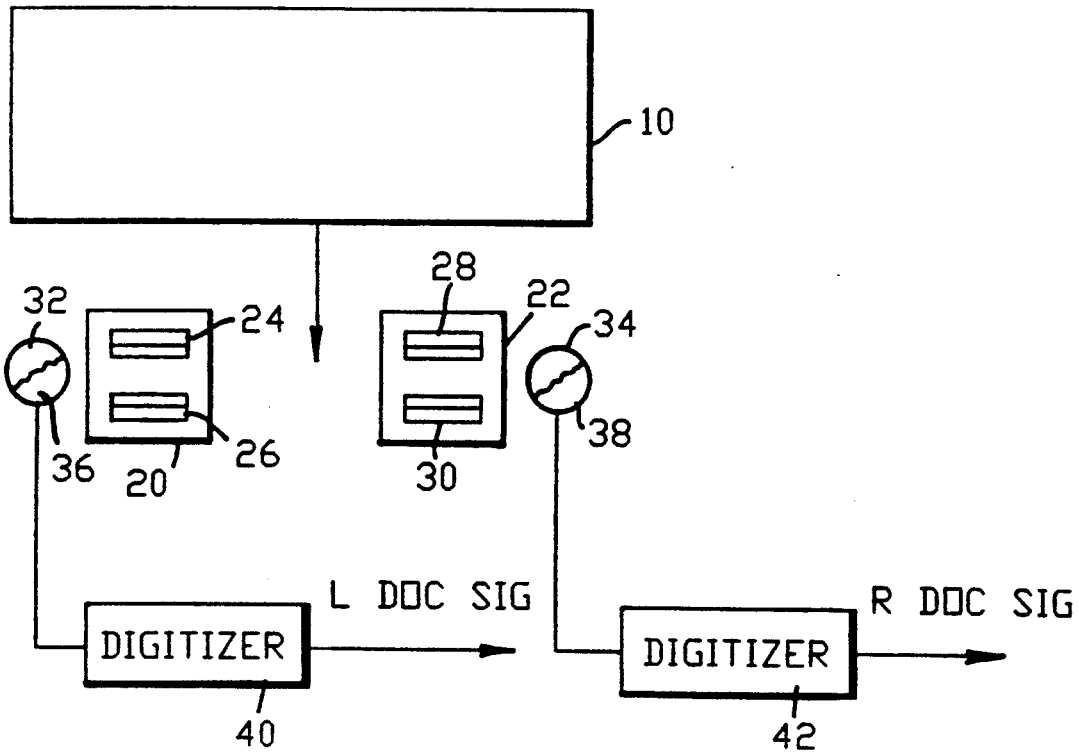
FIG. 2

COMBINED CONDUCTIVITY AND MAGNETIC CURRENCY VALIDATOR

FIELD OF THE INVENTION

The invention is in the field of currency validators and more particularly the invention relates to a currency validator which tests both the magnetic and electrically conductive properties of the ink with which a currency note is printed.

BACKGROUND OF THE INVENTION

There are known in the prior art various arrangements for determining the validity of currency notes. Further as is known in the art, the U.S. currency notes are printed at least in part with ink containing magnetic particles. Many of the validators of the prior art employ magnetic techniques for validating notes.

One example of a currency validator of the prior art which relies on the magnetic character of the ink with which the notes are printed is my prior U.S. Pat. No. 5,068,519 issued Nov. 26, 1991. The apparatus disclosed in my prior patent produces a first signal as a measure of the saturation magnetization of a portion of the document printed with magnetic ink and a second signal as a measure of the remanent magnetization of the portion. The ratio of the second signal to the first provides a measure of the genuineness of the document.

While the apparatus shown in my prior patent is entirely satisfactory in determining the magnetic characteristics of a valid currency note, some counterfeits such as represented by Interpol's indicatives 12A14342E, 12A7513, 12A14342AV and others are magnetically indistinguishable from genuine currency notes. While such counterfeits may incorporate printing defects, the visual characteristics of the notes are extremely difficult to discern in the context of automated high speed currency counting operations.

Counterfeits of the type mentioned hereinabove are printed in part with ink which weakly conducts electrical current whereas genuine currency is printed with inks that are essentially non-conductive.

SUMMARY OF THE INVENTION

One object of my invention is to provide a currency note validator which detects counterfeits which are magnetically indistinguishable from genuine currency.

Another object of my invention is to provide a currency note validator which is especially adapted for use in high speed currency handling operations.

Yet another object of my invention is to provide a currency note validator which combines a magnetic test with an electrical conductivity test.

A further object of my invention is to provide a currency note validator which is certain in operation.

A still further object of my invention is to provide a currency note detector which is simple in construction and in operation for the result achieved thereby.

Other and further objects will appear from the following description.

BRIEF DESCRIPTION OF THE DRAWINGS

In the accompanying drawings to which reference is made in the instant specification and which are to be read in conjunction therewith and in which like reference characters are used to indicate like parts in the various views:

FIG. 1 is a diagrammatic view of a currency note handling device incorporating my combined magnetic and conductance note validator.

FIG. 2 is a diagrammatic view of the apparatus shown in FIG. 1 further illustrating a currency note handling device provided with my combined magnetic and conductance currency note validator.

FIG. 3 is a front elevation of one form of my combined magnetic and conductance currency note validator.

DESCRIPTION OF THE PREFERRED EMBODIMENT

Figure 4:
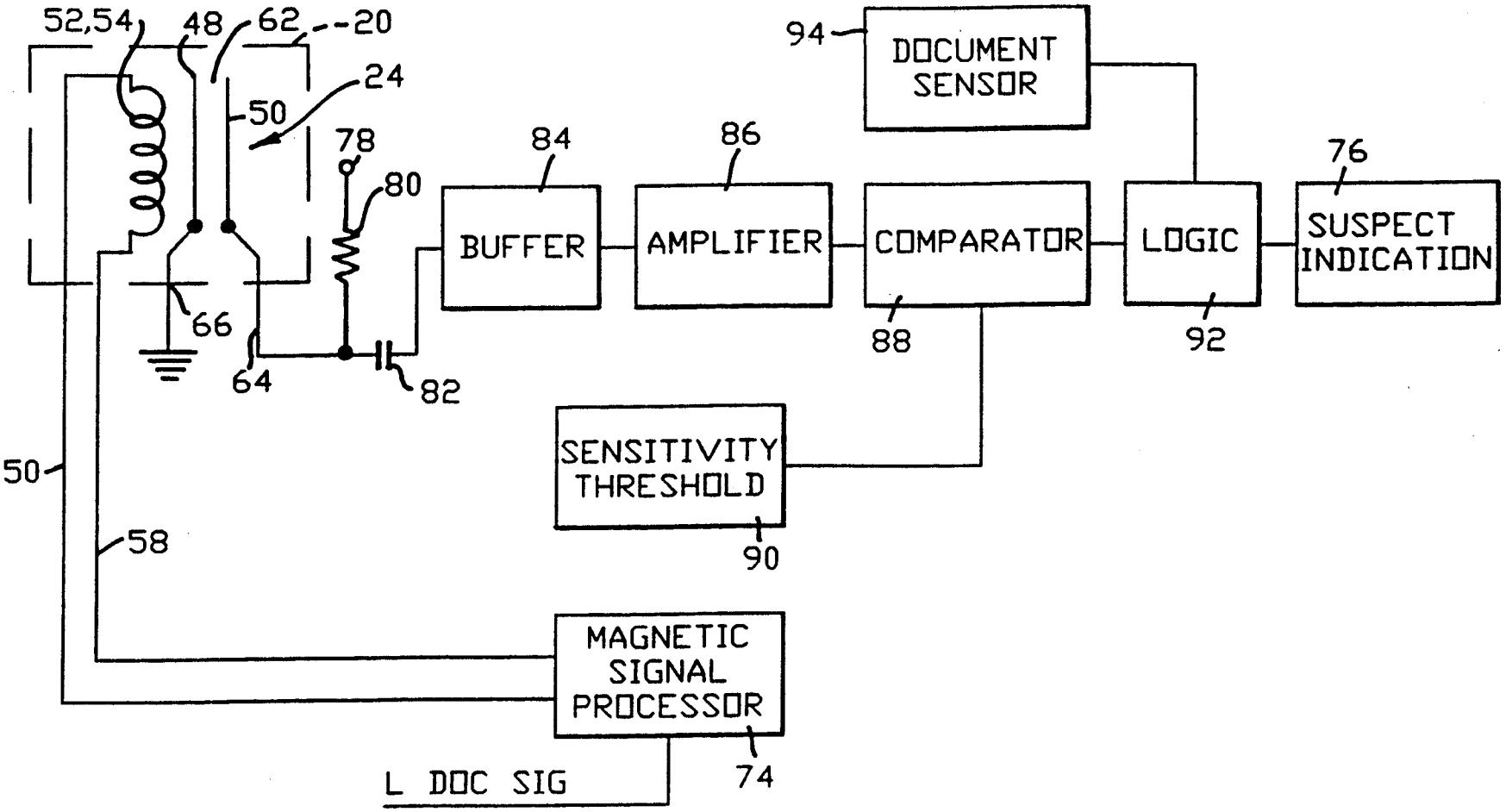
FIG. 4 is a block diagram illustrating the various components of my combined magnetic and conductance currency note validator.

Referring now to FIGS. 1 and 2 of the drawings, a currency note handling device which may be provided with my combined magnetic and conductance currency note validator is adapted to move a currency note 10 in a direction generally perpendicular to the length thereof. The feeding may be accomplished by any suitable means, such for example as a pair of feed rolls 16 and 18. After leaving the feed rolls 12 and 14, the note 10 is moved past dual channel read and write heads 20 and 22 and is picked up by feed rolls 16 and 18. Heads 20 and 22 are of the type shown in FIG. 5 and described in my prior U.S. Pat. No. 5,068,519, the disclosure of which is incorporated herein by reference.

As is pointed out in detail in my prior patent, the respective heads 20 and 22 comprise pairs of cores 24 and 26 and 28 and 30. Respective location detectors comprising spaced light emitters 32 and 34 and associated photodetectors 36 and 38 provide respective input signals to digitizing circuits 40 and 42 which provide signals L DOC SIG (Left Document Signal) and R DOC SIG (Right Document Signal) which are used to control timing in the signal processing circuit in the manner described hereinbelow.

Referring now to FIG. 3, feed rollers (not shown) located downstream of the heads 20 and 22 pick up the note 10 and deliver it to an output tray or the like (not shown). FIG. 3 shows the details of one of the dual channels of the heads 20 and 22. For example, the core indicated generally by the reference character 24 of the head 20, as modified by my invention disclosed herein, includes respective legs 48 and 50 carrying windings 52 and 54. The legs 48 and 50 form an upper gap 56 which may be filled with any nonmagnetic nonconductive material such as glass or ceramic. Windings 52 and 54 are connected to provide an output on conductors 58 and 60, which output is influenced by the magnetic areas on the note 10 in the manner described in my prior patent.

In accordance with my invention as disclosed herein, the two legs 48 and 50 form a lower electrically insulating gap 62. It will readily be appreciated that, if desirable for mechanical reasons, the gap 62 may be filled with insulating material. I form the legs 48 and 50 of conductive magnetic material. I connect respective electrical conductors 66 and 64 to the legs 48 and 50. It will readily be seen that the conductors 64 and 66 normally are insulated from each other. However, should conductive material bridge the gap 56, an electrical circuit would be complete from conductor 66 through leg 48 across gap 56 and through leg 50 to conductor 64.

A roller 68 formed of any suitable material such for example as foam rubber or the like, is carried by a shaft 70 so that the roller 68 urges a currency note passing across the gap into intimate contact with the portions of the legs 48 and 50 at the sides of the gap. This ensures that any conductive material on the bill will complete an electrical path across the gap 56.

Referring now to FIG. 4, in operation of the magnetic portion of my currency note validator, the signal on lines 50 and 58 from the windings 52, 54 on core 24, together with the signal on the windings (not shown) on the core 26, are passed to a magnetic signal processor 74 which also receives the L DOC SIG from the digitizer 40. The circuitry making up the processor 74 which will not be described in detail herein is shown and described in my prior U.S. Pat. No. 5,068,519 referred to hereinabove. The signals from head 22 together with the R DOC SIG signal from digitizer 42 also are fed to the processor 74 in the manner shown in my prior patent. If the processor indicates that the note on the test does not meet the magnetic requirements, a suspect indication is given at 76.

I connect a resistor 80 and a capacitor 82 in series between a terminal 78 connected to a source of +12 volts, for example, and the input to a buffer 84. Conductor 64 is connected to the common terminal of resistor 80 and capacitor 82 while conductor 66 is grounded. In one particular embodiment, the resistor 80 may have a value of for example 100,000 ohms and the capacitor may have a value of 0.1 microfarad.

As a document, such as a currency note, passes through the apparatus the roller 68 urges it into intimate contact with the portions of the legs 48 and 50 at the sides of the gap 56. If the material bridging the gap is essentially non-conductive, essentially no current flows through the resistor 80 and the voltage at the junction of the resistor 80 and the capacitor 82 remains at +12 volts. This is the condition which exists when the currency note is genuine.

If the conductive ink which is present on some counterfeits, as discussed hereinabove, bridges the gap 56 current flows from the terminal 78 through resistor 80 through the legs 48 and 50 and the conductive ink bridging them to ground. This current flow lowers the voltage developed at the junction of resistor 80 and capacitor 82. The capacitor 82 passes this change in voltage to a buffer 84 which isolates the conductivity sensing components from the subsequent circuitry. It will be apparent that the change in voltage at the common terminal of resistor 80 and capacitor 82 is a measure of the conductivity of the material bridging the gap 62.

We feed the output of buffer 84 to an amplifier 86. The amplification provided by amplifier 86 increases the sensitivity of the circuit while avoiding problems associated with measuring small changes in voltage. We apply the output of the amplifier 86 to a comparator 88 which receives a reference value from a sensitivity threshold 90. If the output of the amplifier 86 exceeds the voltage put out by the sensitivity threshold 90, comparator 88 produces an output which is applied to a logic block 92. This block 92 also receives a signal from a document sensor 94 so as to determine if there is conductivity during the time when the document is across the pickup head 20. It will readily be appreciated that the document sensor 94 could be made up of the elements 32 and 36 and the digitizer 40.

If the logic circuit 92 indicates that there is conductivity during the passage of a document, the block 92 puts out a suspect indication at 76 which results in stopping of the feeding mechanism, activation of an audible alarm and an appropriate message on the display of the machine.

It will be seen that I have accomplished the objects of my invention. I have provided a currency note validator which detects counterfeits which are magnetically indistinguishable from genuine currency. My validator combines a magnetic test with an electrical conductivity test. It is especially adapted for use in high speed currency handling systems. It is certain in operation. It is simple in construction and in operation for the result achieved thereby.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A currency validator for producing an indication of a suspect currency note including in combination means for performing a first test of the magnetic properties of a note, means for performing a second test of the electrical conductivity of the note, and means responsive to said test performing means for producing said indication if said note fails either of said tests.

2. A currency validator as in claim 1 in which electrical conductivity in said note results in a failure of said second test.

3. A currency validator as in claim 1 in which said first test is a measure of the ratio of remanent magnetization to saturation magnetization.

4. A currency validator as in claim 1 in which said second test performing means comprises a pair of conductive members separated by an insulating gap and means for detecting the presence of conductive material bridging said gap.

5. A currency validator as in claim 4 in which said detecting means produces a signal in response to the presence of conductive material bridging said gap, said means responsive to said test performing means comprising means for comparing said signal with a reference.

6. A currency validator as in claim 4 including means for conveying said note past said gap and means for urging said note into engagement with said gap forming elements as said note passes said gap.

7. A currency note validator for testing the genuineness of a currency note including in combination, a core comprising a pair of legs of magnetic and electrically conductive material, said legs forming a first gap, an electrical winding carried by said legs, means for conveying a currency note to be tested across said gap, first testing means including said windings for testing the magnetic properties of said note and second testing means responsive to the presence of conductive material bridging said first gap for testing the electrical conductivity of said note.

8. A currency note validator as in claim 7 in which said second testing means comprises a second gap formed by said legs at a location spaced from said first gap and means connected across said second gap for detecting the presence of conductive material bridging said first gap.

9. A currency note validator as in claim 8 in which said detecting means comprises means for producing a current flow through conductive material bridging said first gap.

10. A currency note validator as in claim 9 in which said current flow producing means comprises a source of potential and a resistor connected in series with said legs across said potential source.

11. A currency note validator as in claim 7 including means for urging a bill passing said first gap into intimate contact with the portions of said poles adjacent said gaps.

* * * * *